US012285087B1

(12) United States Patent
Fu

(10) Patent No.: US 12,285,087 B1
(45) Date of Patent: Apr. 29, 2025

(54) FLAT-BACK EARPLUG

(71) Applicant: Jinbo Fu, Jiujiang (CN)

(72) Inventor: Jinbo Fu, Jiujiang (CN)

( * ) Notice: Subject to any disclaimer, the term of this patent is extended or adjusted under 35 U.S.C. 154(b) by 0 days.

(21) Appl. No.: 18/915,124

(22) Filed: Oct. 14, 2024

(51) Int. Cl.
*A44C 7/00* (2006.01)

(52) U.S. Cl.
CPC ..... *A44C 7/003* (2013.01)

(58) Field of Classification Search
CPC ..... A44C 7/003; Y10T 24/32; Y10T 24/41; Y10T 24/3649; Y10T 24/3651; Y10T 24/366; Y10T 24/3483; Y10T 24/4604; Y10T 24/4605; Y10T 24/4621; Y10T 24/4625; Y10T 24/4627; Y10T 24/4629; Y10T 24/4641; Y10T 24/4646; A44D 2203/00
See application file for complete search history.

(56) References Cited

U.S. PATENT DOCUMENTS 10,299,547 B2 * 5/2019 Reil ..... A44C 15/0035

FOREIGN PATENT DOCUMENTS

GB 1044489 A * 9/1966 ..... A44C 7/003

* cited by examiner

*Primary Examiner* — Jack W Lavinder
(74) *Attorney, Agent, or Firm* — Hemisphere Law, PLLC; Zhigang Ma

(57) ABSTRACT

A flat-back earplug includes an upper ring and a lower ring. The upper ring is defined with a passage used to accommodate an ear post of an ear stud to pass through, the ear post of the ear stud is inserted from one side of the passage and passes out from the other side of the passage, and an end surface of the upper ring for accommodating an insertion of the ear post is in contact with an ear. The lower ring is defined with an accommodation cavity, the upper ring is inserted into the accommodation cavity, and a U-shaped clasp used to fix the ear post is arranged in a gap between the upper ring and the accommodation cavity, and a part of the ear post passing out from the passage extends into the accommodation cavity and is clamped on the U-shaped clasp.

7 Claims, 2 Drawing Sheets

FLAT-BACK EARPLUG

TECHNICAL FIELD

The disclosure relates to the technical field of earring clutches, and more particularly to a flat-back earring clutch.

BACKGROUND

Ear studs are a type of ornament worn on the ears, smaller than earrings and shaped like nails. Generally, they typically require a pierced ear to be worn, with the ear stud featuring a variety of designs on the front of the earlobe and an earring clutch on the back of the earlobe.

The ear post on the ear stud is secured by the earring clutch after passing through the hole in the ear. In the related art, the snap-fit structure of the earring clutch against the ear post will directly abut against the ear, and the ear is easily damaged in a long-term extrusion friction process due to different shapes of the snap-fit structure.

SUMMARY

The disclosure provides a flat-back earring clutch, which aims to solve the problem that the snap-fit structure of the earring clutch on the ear post will directly abut against the ear at present, and the ear is easily damaged in a long-term extrusion and friction process due to the different shapes of the snap-fit structure.

The disclosure is realized as follows. Specifically, a flat-back earring clutch, which is applied to the fixation of an ear stud, includes an upper ring and a lower ring.

The upper ring is defined with a passage configured (i.e., arranged and structured) to accommodate an ear post of the ear stud to pass through, and the ear post of the ear stud is inserted from one side of the passage and passes out from the other side of the passage. An end surface of the upper ring for accommodating an insertion of the ear post is in contact with an ear.

The lower ring is defined with an accommodation cavity, the upper ring is inserted into the accommodation cavity, a U-shaped clasp configured to fix the ear post is arranged in a gap between the upper ring and the accommodation cavity, and a part of the ear post passing out from the passage extends into the accommodation cavity and is clamped on the U-shaped clasp.

In an embodiment, an outer diameter of the upper ring is matched with the accommodation cavity, and the lower ring is nested outside the upper ring through the accommodation cavity.

In an embodiment, the passage is composed of a cavity and a guide hole, and the ear post is inserted from a side of the cavity and passes out from a side of the guide hole.

In an embodiment, the cavity is a tapered hole structure, the guide hole is a round hole, and the cavity and the guide hole are connected to each other to form a counterbore structure.

In an embodiment, a diameter of the guide hole is matched with the ear post.

In an embodiment, the cavity is arranged on the end surface of the upper ring in contact with the ear.

In an embodiment, a bottom of the accommodation cavity is defined with a groove, the part of the ear post clamped in the U-shaped clasp has a portion passing through the U-shaped clasp and extending into the groove.

In an embodiment, the upper ring is provided with an inner magnetic ring, the inner magnetic ring is arranged close to the end surface of the upper ring defined with the cavity, the lower ring is provided with an outer magnetic ring on an end surface of the accommodation cavity, and the inner magnetic ring and the outer magnetic ring are magnetically connected.

In an embodiment, the U-shaped clasp includes two parallel cylinders and a semicircular ring. The two parallel cylinders are respectively connected at two ends of the semicircular ring, and a distance between the two parallel cylinders is smaller than a diameter of the ear post.

Compared with the related art, embodiments of the disclosure mainly have the following beneficial effects.

1. The flat-back earring clutch provided by the disclosure completes the fixation of the ear stud through the use of the U-shaped clasp and the ear post that form a snap-fit, and the upper ring is used as a transition piece to prevent the snap-fit structure from directly contacting the ear, thus reducing the damage to the ear. In this way, the damage of the earring clutch to the ear can be effectively alleviated, and at the same time, the upper ring can provide a larger area to reduce the pressure exerted on the ear by the snap-fit pressure.

2. The flat-back earring clutch provided by the disclosure is defined with the cavity as the tapered hole structure and the guide hole as the round hole. When the upper ring abuts against the surface of the ear, the cavity helps the upper ring to form a space on the surface of the ear to avoid long-term tight pressing and affect skin health, and the damage to the skin is alleviated through the cavity.

3. The upper ring and the lower ring of the flat-back earring clutch provided by the disclosure are connected by magnetic attraction, which can separate the upper ring and the lower ring, and the lower ring is assembled outside the upper ring and the U-shaped clasp, mainly to prevent the U-shaped clasp from falling off easily due to external interference.

DESCRIPTION OF REFERENCE SIGNS

10. upper ring; 11. cavity; 12. guide hole; 13. inner magnetic ring; 20. U-shaped clasp; 30. lower ring; 31. accommodation cavity; 32. outer magnetic ring; 33. groove.

DETAILED DESCRIPTION OF EMBODIMENTS

Unless otherwise defined, all technical and scientific terms used herein have the same meaning as commonly understood by those skilled in the art of the disclosure. The terminology used in the specification of the disclosure herein is only for the purpose of describing specific embodiments and is not intended to limit the disclosure. The terms "including" and "having" in the specification and claims of the disclosure and the description of the above drawings, as well as any variations thereof, are intended to cover non-exclusive inclusion. The terms "first" and "second" in the specification and claims of the disclosure or the above drawings are used to distinguish different objects, not to describe a specific order.

Reference to "embodiment" herein means that a particular feature, structure or characteristic described in connection with an embodiment can be included in at least one embodiment of the present application. The appearance of this phrase in various places in the specification does not necessarily refer to the same embodiment, nor is it an independent or alternative embodiment mutually exclusive with other embodiments. It is understood explicitly and implicitly by those skilled in the art that the embodiments described herein can be combined with other embodiments.

Figure 1:
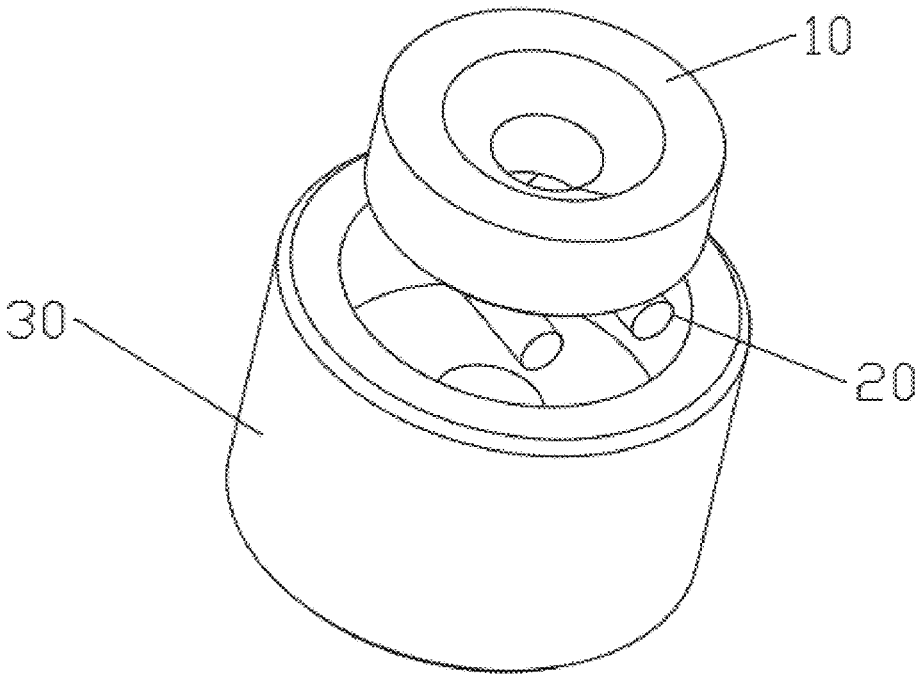
FIG. 1 illustrates a schematic structural diagram of a flat-back earring clutch according to the disclosure.
Figure 2:
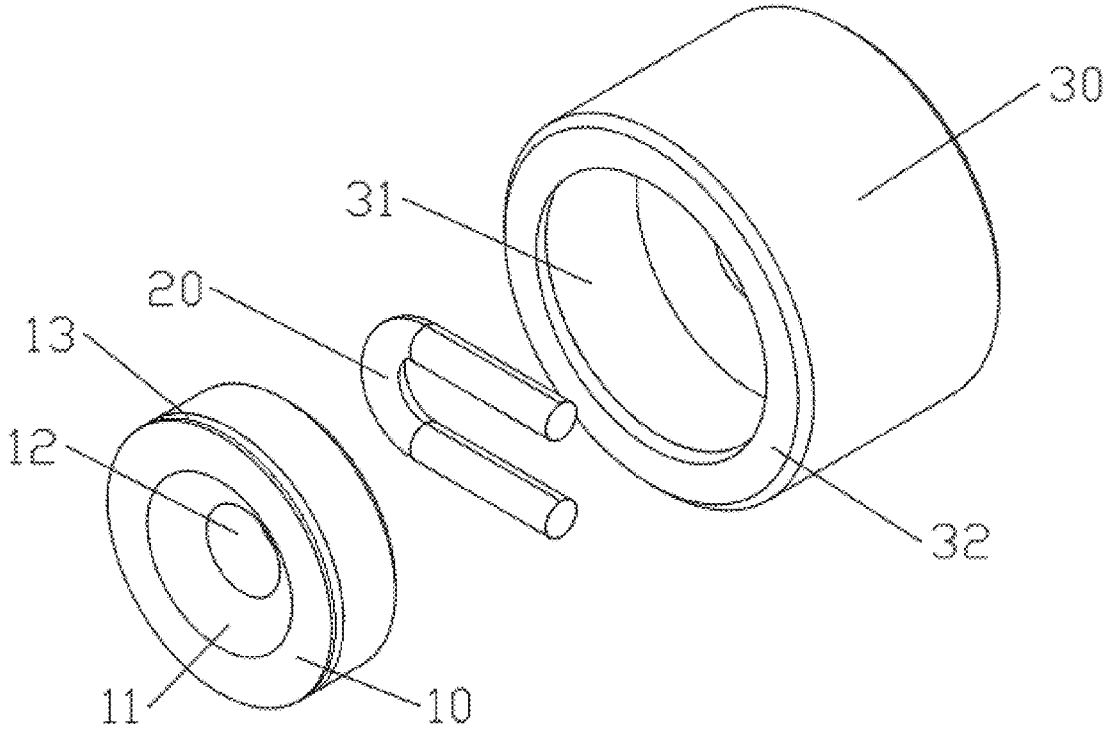
FIG. 2 illustrates a schematic exploded structural diagram of the flat-back earring clutch according to the disclosure.
Figure 3:
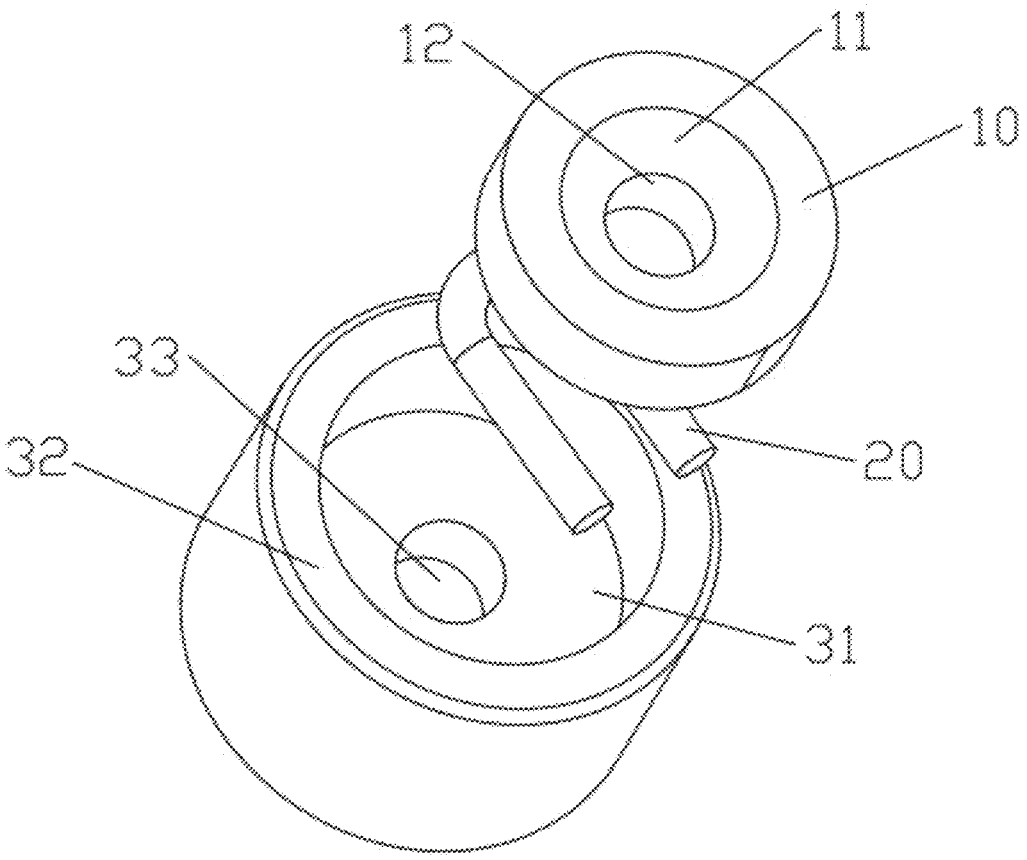
FIG. 3 illustrates a schematic structural diagram of a lower ring and an upper ring of the flat-back earring clutch according to the disclosure.

The embodiment of the disclosure provides a flat-back earring clutch, which is applied to the fixation of ear studs. As shown in FIG. 1, the flat-back earring clutch includes an upper ring 10 and a lower ring 30.

The upper ring 10 is defined with a passage configured to accommodate an ear post of the ear stud to pass through, and the passage is composed of a cavity 11 and a guide hole 12. The ear post of the ear stud is inserted from one side of the cavity 11 and passes out from one side of the guide hole 12. An end surface of the upper ring 10 defined with the cavity 11 is in contact with an ear.

The lower ring 30 is defined with an accommodation cavity 31, the upper ring 10 is inserted into the accommodation cavity 31, a U-shaped clasp 20 configured to fix the ear post is arranged in a gap between the upper ring 10 and the accommodation cavity 31, and a part of the ear post passing out from one side of the guide hole 12 (i.e., passing out from the passage) extends into the accommodation cavity 31 and is clamped on the U-shaped clasp 20.

In this embodiment, an outer diameter of the upper ring 10 is matched with the accommodation cavity 31, and the lower ring 30 is nested on the outside of the upper ring 10 through the accommodation cavity 31. The U-shaped clasp 20 is arranged in the accommodation cavity 31, and when the upper ring 10 is inserted into the accommodation cavity 31, the upper ring 10 will abut against the U-shaped clasp 20, and the part of the ear post passing out from one side of the guide hole 12 will also be inserted into a U-shaped area on the U-shaped clasp 20. The U-shaped area forms a snap-fit effect on the ear post. Here, the U-shaped clasp 20 is made of flexible material, which can be made of elastic silicone rubber or thermoplastic elastomers (TPE). It should be noted that the U-shaped clasp 20 is composed of two parallel cylinders and a semicircular ring, the two parallel cylinders are respectively connected at two ends of the semicircular ring, and a distance between the two parallel cylinders is smaller than a diameter of the ear post. Here, the parallel cylinders provide the effect of limiting and fixing the ear post.

In the disclosure, the U-shaped clasp 20 and the ear post are engaged to fix the ear stud, and the upper ring 10 is used as a transition piece to prevent the snap-fit structure from directly contacting the ear, thereby reducing the damage to the ear. In this way, the damage to the ear caused by the earring clutch can be effectively alleviated, and at the same time, the upper ring 10 can provide a larger area to reduce the pressure exerted on the ear by the snap-fit pressure.

In an embodiment, the cavity 11 is a tapered hole structure, the guide hole 12 is a circular hole, and the cavity 11 and the guide hole 12 are connected to each other to form a counterbore structure. A diameter of the guide hole 12 is matched with the ear post, and the cavity 11 helps the upper ring 10 to form a space on the surface of the ear to avoid long-term tight press-fitting, which will affect the skin health and alleviate the damage to the skin through the space.

In an embodiment, a bottom of the accommodation cavity 31 is defined with a groove 33. The part of the ear post clamped in the U-shaped clasp 20 has a portion passing through the U-shaped clasp 20 and extending into the groove 33, and the groove 33 will serve as an accommodation area for the portion of the ear post extending out of the U-shaped clasp 20.

It should be specifically noted that both the groove 33 and the accommodation cavity 31 are blind-hole structures, the ear post is finally wrapped inside the lower ring 30, and the ear post cannot penetrate through the lower ring 30.

In an embodiment, the upper ring 10 is provided with an inner magnetic ring 13, and the inner magnetic ring 13 is arranged close to the end surface of the upper ring 10 defined with the cavity 11. The lower ring 30 is provided with an outer magnetic ring 32, and the outer magnetic ring 32 and the inner magnetic ring 13 are magnetically connected.

In this embodiment, generally speaking, the upper ring 10 and the lower ring 30 are not intended to be disassembled. When it is inconvenient to remove the ear post, the upper ring 10 and the lower ring 30 can be separated, and the U-shaped clasp 20 can be manually removed from the end of the ear post to complete the positioning and fixation. Here, another function of the lower ring 30 is to protect the U-shaped clasp 20 from falling off easily due to external interference.

In this embodiment, corners of the upper ring 10 and the lower ring 30 are rounded to reduce the abrasion damage to the ear.

It should be noted that for the sake of simple description, all the aforementioned embodiments are expressed as a series of action combinations, but those skilled in the art should understand that the disclosure is not limited by the described action sequence, because some steps may be performed in other sequences or simultaneously according to the disclosure. In addition, those skilled in the art should also understand that the embodiments described in the specification are all illustrated embodiments, and the actions and modules involved are not necessarily essential to the disclosure.

The above embodiments are only used to illustrate the technical scheme of the disclosure, and do not limit the protection scope of the disclosure. Apparently, the described embodiments are only a part of the embodiments of the disclosure, not all of them. Based on these embodiments, all other embodiments obtained by those skilled in the art without creative work belong to the scope to be protected by the disclosure. Although the disclosure has been described in detail with reference to the above-mentioned embodiments, those skilled in the art can still combine, add, delete or make other adjustments to the features in various embodiments of the disclosure according to the situation without any conflict, so as to obtain different technical solutions that are not essentially deviate from the concept of the disclosure, and these technical solutions also belong to the scope of protection of the disclosure.

What is claimed is:

1. A flat-back earring clutch, configured to fix an ear stud, comprising:

an upper ring (10), wherein the upper ring (10) is defined with a passage configured to accommodate an ear post of the ear stud to pass through, and the ear post of the ear stud is inserted from one side of the passage and passes out from the other side of the passage; and an end surface of the upper ring (10) for accommodating an insertion of the ear post is in contact with an ear; and a lower ring (30), wherein the lower ring (30) is defined with an accommodation cavity (31), the upper ring (10) is inserted into the accommodation cavity (31), a U-shaped clasp (20) configured to fix the ear post is located within the accommodation cavity (31) between the upper ring (10) and a bottom floor of the lower ring (30) defining a bottom surface of the accommodation cavity (31), and a part of the ear post passing out from the passage extends into the accommodation cavity (31) and is clamped on the U-shaped clasp (20);

wherein the passage is composed of a cavity (11) and a guide hole (12), and the ear post is inserted from a side of the cavity (11) and passes out from a side of the guide hole (12); and wherein the upper ring (10) is provided with an inner magnetic ring (13), the inner magnetic ring (13) is arranged close to the end surface of the upper ring (10) defined with the cavity (11), the lower ring (30) is provided with an outer magnetic ring (32) on an end surface of the accommodation cavity (31), and the inner magnetic ring (13) and the outer magnetic ring (32) are magnetically connected.

2. The flat-back earring clutch as claimed in claim 1, wherein an outer diameter of the upper ring (10) is matched with the accommodation cavity (31), and the lower ring (30) is nested outside the upper ring (10) through the accommodation cavity (31).

3. The flat-back earring clutch as claimed in claim 1, wherein the cavity (11) is a tapered hole structure, the guide hole (12) is a round hole, and the cavity (11) and the guide hole (12) are connected to each other to form a counterbore structure.

4. The flat-back earring clutch as claimed in claim 3, wherein a diameter of the guide hole (12) is matched with the ear post.

5. The flat-back earring clutch as claimed in claim 4, wherein the cavity (11) is arranged at the end surface of the upper ring (10) in contact with the ear.

6. The flat-back earring clutch as claimed in claim 1, wherein a bottom of the accommodation cavity (31) is defined with a through-hole (33); the part of the ear post clamped in the U-shaped clasp (20) has a portion passing through the U-shaped clasp (20) and extending into the through-hole (33).

7. The flat-back earring clutch as claimed in claim 1, wherein the U-shaped clasp (20) comprises two parallel cylinders and a semicircular ring, the two parallel cylinders are respectively connected at two ends of the semicircular ring, and a distance between the two parallel cylinders is smaller than a diameter of the ear post.

* * * * *